US008122617B1

(12) United States Patent
Dixon et al.

(10) Patent No.: US 8,122,617 B1
(45) Date of Patent: Feb. 28, 2012

(54) BOOT WITH HEEL SPIKES AND METHOD OF USE THEREOF

(76) Inventors: Kenneth R. Dixon, Claresholm (CA); Debra Dixon, Claresholm (CA)

( * ) Notice: Subject to any disclaimer, the term of this patent is extended or adjusted under 35 U.S.C. 154(b) by 962 days.

(21) Appl. No.: 12/151,791

(22) Filed: May 9, 2008

(51) Int. Cl.
*A43C 15/14* (2006.01)

(52) U.S. Cl. ..... 36/61

(58) Field of Classification Search ..... 36/61, 62, 36/134

See application file for complete search history.

(56) References Cited

U.S. PATENT DOCUMENTS

| | | | | |
|---|---|---|---|---|
| 1,349,542 | A | 8/1920 | Yanik | |
| 2,026,013 | A | 12/1935 | Arieti | |
| 3,355,823 | A | 12/1967 | Vogt | |
| 3,693,271 | A * | 9/1972 | Korpei | 36/61 |
| 3,793,751 | A * | 2/1974 | Gordos | 36/61 |
| 3,973,338 | A | 8/1976 | Schwemmer et al. | |
| 4,375,729 | A | 3/1983 | Buchanen, III | |
| 5,813,143 | A | 9/1998 | Bell et al. | |
| 5,870,838 | A * | 2/1999 | Khayat | 36/61 |
| 6,058,627 | A | 5/2000 | Violette et al. | |
| D435,333 | S | 12/2000 | Robbins et al. | |
| 6,154,982 | A | 12/2000 | Bell et al. | |
| 6,256,907 | B1 * | 7/2001 | Jordan et al. | 36/61 |
| 6,389,714 | B1 * | 5/2002 | Mack | 36/61 |
| 6,449,880 | B1 * | 9/2002 | Calabrese et al. | 36/61 |

* cited by examiner

*Primary Examiner* — Ted Kavanaugh
(74) *Attorney, Agent, or Firm* — Montgomery Patent & Design, LLC; Robert C. Montgomery; Joseph T. Yaksich

(57) ABSTRACT

A shoe with retractable metal spikes on a heel area is herein disclosed. A bottom portion of a shoe heel comprises a plurality of metal spikes that retract in and out via a cam plate, driven by a cam lever and activated by a control dial located on the outside face of the heel. When the metal spikes are extended, they can be used to walk safely on snow and/or ice, and can also be used in wintertime sporting events. The metal spikes can be retracted by simply turning the dial and allowing them to retract flush or slightly below the surface of the shoe sole. The invention is viewed as being particularly useful for those in construction, public service, law enforcement or any profession in which walking outside in winter conditions and walking inside on finished floors is a regular and repeating part of their work day.

12 Claims, 5 Drawing Sheets

BOOT WITH HEEL SPIKES AND METHOD OF USE THEREOF

RELATED APPLICATIONS

The present invention was first described in an Official Record of Invention on Mar. 1, 2007; on file at the offices of Montgomery Patent and Design, LLC. There are no previously filed, nor currently any co-pending applications, anywhere in the world.

FIELD OF THE INVENTION

The present invention relates generally to footwear with an integral retractable spike assembly located therein a heel portion thereof said footwear and to a method for retracting and deploying said spike assembly.

BACKGROUND OF THE INVENTION

Almost every state in the U.S. has seen snowfall or below-freezing temperatures at some point. In fact, forty-four (44) of the fifty (50) states will typically see temperatures as low as ten degrees (10 F.°) over the course of the winter.

Those of us who live in those areas where the winter climate brings snow, sleet, high winds and ice know the harshness and hazards associated with such weather. For those who must walk outside in such conditions, ice and snow present a major slipping risk. Studded shoes, or clip on devices provide some protection against these dangers, but quickly become impractical when walking in and out of buildings all day. If left on when walking on finished floors, such devices can quickly cause damage to the surface or might even present tripping or slipping hazards, themselves.

Accordingly, there exists a need for a means by which one can walk safely on snow and ice without the disadvantages mentioned above. The development of the present invention fulfills this need.

U.S. Pat. No. D 435,333 filed by Robbins et al. discloses a footwear tread. This design patent does not appear to disclose a similar ornamental or industrial design to the instant invention nor does it appear to disclose an integral spike mechanism located solely in the heel portion of the article of footwear that extends and retracts spikes through the use of an activation dial.

U.S. Pat. No. 6,154,982 filed by Bell discloses a readily mountable traction enhancing attachment for footwear. This patent does not appear to disclose an integral spike mechanism located in the heel portion of an article of footwear.

U.S. Pat. No. 6,058,627 filed by Violette discloses all-terrain footwear with retractable spikes. This patent does not appear to disclose an integral spike mechanism located solely in the heel portion of the article of footwear that extends and retracts spikes through the use of an activation dial.

U.S. Pat. No. 5,813,143 filed by Bell and Bell discloses a convertible non-slip footwear attachment device having ice/snow engaging cleats. This patent does not appear to disclose an integral spike mechanism located in the heel portion of an article of footwear.

U.S. Pat. No. 4,375,729 filed by Buchanen discloses footwear having retractable spikes. This patent does not appear to disclose an integral spike mechanism located solely in the heel portion of the article of footwear that extends and retracts spikes through the use of an activation dial.

U.S. Pat. No. 3,973,338 filed by Schwimmer and Crozier discloses a spike heel plate. This patent does not appear to disclose an integral spike mechanism located solely in the heel portion of the article of footwear capable of extending and retracting the spikes through the use of an activation dial.

U.S. Pat. No. 3,355,823 filed by Vogt discloses a skid protector for footwear. This patent does not appear to disclose an integral spike mechanism located solely in the heel portion of the article of footwear capable of extending and retracting the spikes through the use of an activation dial.

U.S. Pat. No. 2,026,013 filed by Arieti discloses an invention named creeper. This patent does not appear to disclose an integral spike mechanism located solely in the heel portion of the article of footwear capable of extending and retracting the spikes through the use of an activation dial.

U.S. Pat. No. 1,349,542 filed by Yank discloses an ice creeper. This patent does not appear to disclose an integral spike mechanism located solely in the heel portion of the article of footwear capable of extending and retracting the spikes through the use of an activation dial.

The prior art appears to disclose articles possessing spikes that are attachable to footwear or that possess spikes that deploy through a slide mechanism. The prior art does not appear to disclose an integral spike mechanism located solely in the heel portion of the article of footwear that extends and retracts spikes through the use of an activation dial.

SUMMARY OF THE INVENTION

In view of the foregoing disadvantages inherent in the prior art, it has been observed that there is need for a boot with heel spikes which provides a means for a specialized shoe with retractable metal spikes on the heel area. With the metal spikes in an extended position, the boots can be used to walk safely on snow and/or ice, and can also be used in wintertime sporting events.

Therefore, an object of the present invention provides for the bottom portion of the heel to comprise four (4) metal spikes that retract in and out via a cam plate, driven by a crank shaft which is manually activated by an activation dial located on the outside face of the heel.

Another object of the present invention provides for the boot with heel spikes to comprise a shoe assembly, a spike retracting mechanism, a lid assembly, four (4) spikes, and an activation dial. The boot with heel spikes may be a standard work shoe comprising expected features such as, but not limited to, an upper shoe portion, a lower shoe portion, a sole, a heel, a tongue, padding, a plurality of lacing eyelets, and an insole. The shoe assembly further provides custom features including an internal cavity located in a heel area and four (4) heel apertures.

Another object of the present invention provides a mounting means thereto a spike retracting mechanism and lid assembly. The cavity is formed within the heel portion having particular internal rectangular dimensions providing a snug fit thereto the spike retracting mechanism and lid assembly. The spike retracting mechanism and lid assembly form a rectangular shape sized so as to fit discretely within the heel portion. The spike retracting mechanism and lid assembly are held permanently therein said cavity using preferably a durable weather-resistant adhesive. The insole portion provides a user with a comfortable covering of the spike retracting mechanism and lid assembly.

Yet another object of the present invention provides for the spike retracting mechanism to further comprises four (4) extendable and retractable cylindrical spikes approximately one-eighth (⅛) inch in diameter which extend outwardly toward a ground or floor surface extending approximately one-quarter (¼) of an inch below a bottom surface of the heel portion. Each spike comprises a sharp conical point at a lower end thereof providing an improved traction means thereto a user. The spikes are slidingly guided through the heel portion via four (4) heel apertures located in a corresponding pattern to that of the spikes, thereby providing a guiding inner diameter to the spikes. Vertical movement of the spikes is provided by a cam plate, a lift strap, and a manually activated crank shaft.

Yet another object of the present invention provides for various articles of footwear to be configured with the spike retracting mechanism, thereby providing an improved traction means to a user.

Still yet another object of the present invention provides for the spike retracting mechanism to comprise an activation dial, four (4) spikes, a base plate, a crank shaft, a pair of crank shaft apertures, four (4) spike apertures, an activation dial slot, a cam plate, a lift strap, and a lift strap groove. The elements of the spike retracting mechanism are envisioned being made using durable corrosion-resistant materials.

Still yet another object of the present invention provides for the base plate to comprise a rugged metal "U"-shaped structure with a horizontal rectangular lower platform approximately two (2) inches long along an edge providing a sturdy mounting platform thereto spike motivating devices within. The base plate provides an attachment means thereto the crank shaft via a pair of opposing crank shaft apertures comprising horizontally aligned drilled holes approximately one-eighth (⅛) inch in diameter located at an intermediate position thereupon the two (2) vertical sides of the base plate along respective upper edges. The crank shaft is rotatably joined to the base plate in the crank shaft apertures extending between said crank shaft apertures. The crank shaft further comprises a parallel offset section formed between said apertures being slidingly engaged to a cam plate. The cam plate comprises a rectangular horizontal metal plate similar in size to the base plate being located above the bottom surface of said base plate and contained between the two vertical sides of the base plate. The cam plate provides a means to convert a rotary motion of the crank shaft to a vertical motion of the cam plate via insertion therein a lift strap being welded to an upper surface of the cam plate.

Another object of the present invention provides for the lift strap to comprise an inverted "U"-shaped metal strap approximately one-quarter (¼) inch wide comprising an offset section defining an enclosed horizontal lift strap groove therewith the upper surface of the cam plate surface. The crank shaft is inserted therein the lift strap groove providing free rotary motion of the crank shaft slidingly inserted therewithin resulting in a vertical displacement of the cam plate. The cam plate provides a permanent attachment means thereto four (4) spikes being affixed thereto.

Another object of the present invention provides for the spikes to be flush with an upper surface of the cam plate and extend perpendicularly downward from said cam plate slidingly protruding through four (4) respective spike apertures located in the horizontal portion of the base plate. The spikes are held securely in an extended position as the crank shaft is rotated slightly beyond a vertical orientation positioning the offset portion of the crank shaft against an extreme end portion of the lift strap groove. While the crank shaft is in this orientation the cam plate and spikes are extended downwardly allowing a user of the boot with heel spikes to walk securely upon a snow and/or icy surface.

Yet another object of the present invention provides for the crank shaft to comprise an end portion which extends through the crank shaft aperture providing an attachment thereto a manually manipulated activation dial being affixed perpendicularly thereto a flat surface of said activation dial. The activation dial provides a circular manual grasping means allowing a user to affect a torque to the internal crank shaft, thereby providing extension and retraction of the spikes as desired. The activation dial comprises a circular knob approximately one (1) inch in diameter comprising parallel vertical flat surfaces providing mechanical engagement of the crank shaft by a centrally located drilled hole therein a rear side thereof being particularly sized so as to engage said crank shaft. The actuation dial further comprises an activation dial slot along a front side thereof providing optional manipulation of said activation dial. The activation dial slot comprises a large female groove-type feature extending diametrically across a front surface of the activation dial face.

Another object of the present invention provides for the boot with heel spikes to possess a spike retracting mechanism portion that provides a user the option of wearing the boot with heel spikes indoors or upon a normal high-friction walking surface.

Still yet another object of the present invention provides for the lid to comprise a five-sided, open bottomed rectangular box which slidingly engages and covers the spike retracting mechanism. The lid works in conjunction with the base plate to form a protective housing around said spike retracting mechanism. The lid comprises a lid top panel, a pair of lid side panels, a lid front panel, a lid rear panel, and a lid front panel slot. The lid front panel further comprises an integral front lid panel slot at an intermediate location providing clearance to the crank shaft which protrudes horizontally through the base plate.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1A:
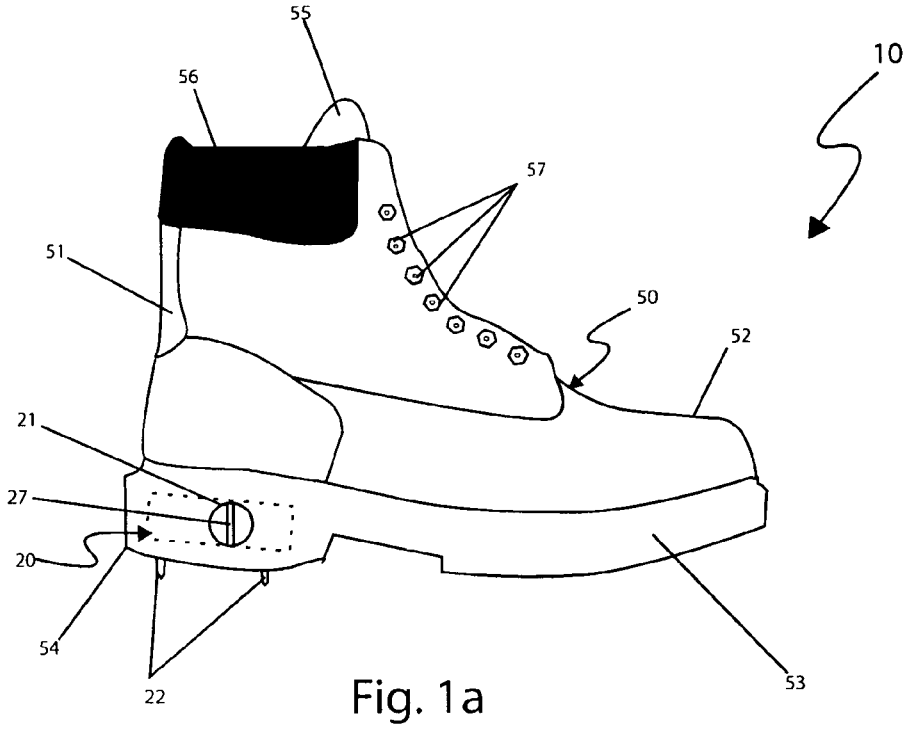
FIG. 1*a* is a side view of a boot with heel spikes 10, according to a preferred embodiment of the present invention.

10 boot with heel spikes
20 spike retracting mechanism
21 activation dial
22 spike
23 base plate
24 crank shaft
25 crank shaft aperture
26 spike aperture
27 activation dial slot
31 cam plate

32 lift strap
33 lift strap groove
40 lid assembly
41 lid top panel
42 lid side panel
43 lid front panel
44 lid rear panel
45 lid front panel slot
50 shoe assembly
51 upper shoe
52 lower shoe
53 sole
54 heel
55 tongue
56 padding
57 lacing eyelets
58 insole
59 cavity
60 adhesive
61 heel aperture

DETAILED DESCRIPTION OF THE PREFERRED EMBODIMENT

The best mode for carrying out the invention is presented in terms of its preferred embodiment, herein depicted within FIGS. 1 through 4*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a boot with heel spikes (herein described as the "apparatus") 10, which provides a means for a specialized shoe 50 with retractable metal spikes 22 on a heel area 54 is herein disclosed. A bottom portion of a shoe heel 54 comprises four (4) metal spikes 22 that retract in and out via a cam plate 31, driven by a crank shaft 24 which is manually activated by an activation dial 21 located on the outside face of the heel 54. When the metal spikes 22 are extended, they can be used to walk safely on snow and/or ice, and can also be used in wintertime sporting events.

Figure 1B:
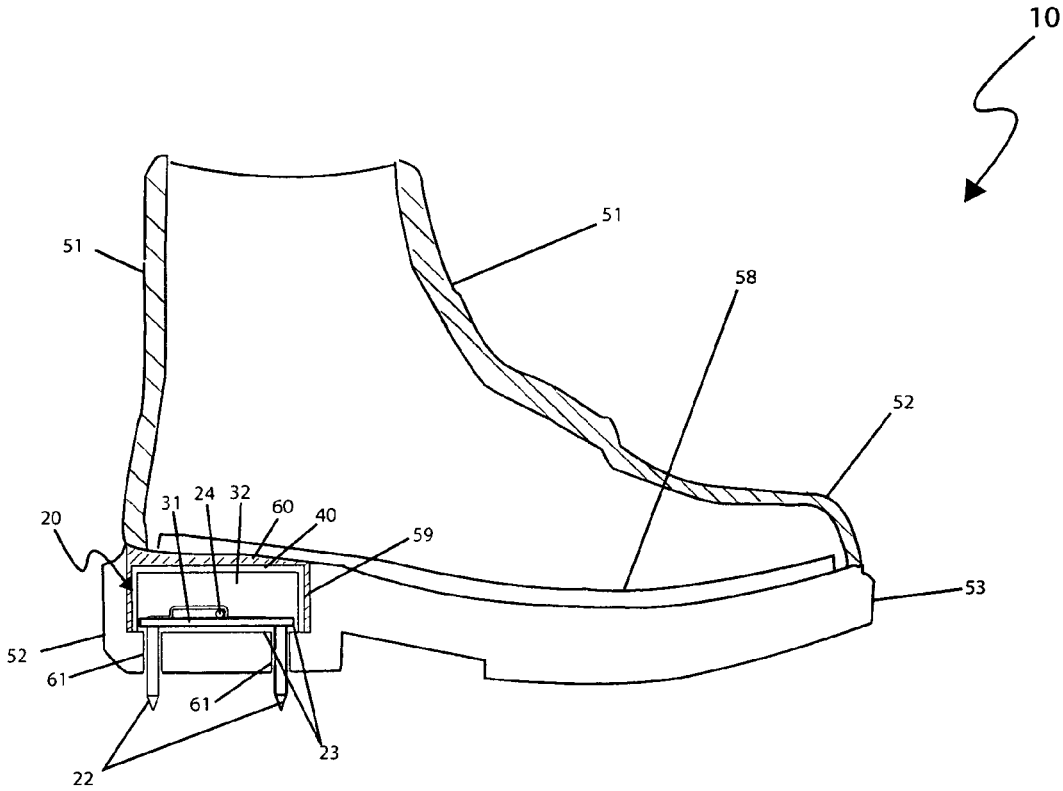
FIG. 1*b* is a side cut-away view of a boot with heel spikes 10, according to a preferred embodiment of the present invention.

Referring now to FIGS. 1*a* and 1*b*, side and cut-away views of the apparatus 10, according to the preferred embodiment of the present invention, are disclosed. The apparatus 10 comprises a shoe assembly 50, a spike retracting mechanism 20, a lid assembly 40, four (4) spikes 22, and an activation dial 21.

The shoe assembly 50 is depicted here being a standard work shoe 50 comprising expected features such as, but not limited to, an upper shoe portion 51, a lower shoe portion 52, a sole 53, a heel 54, a tongue 55, padding 56, a plurality of lacing eyelets 57, and an insole 58. Said shoe assembly 50 is envisioned to be made using conventional shoe manufacturing methods, materials, and processes common in the industry. Said shoe assembly 50 provides further custom features including an internal cavity 59 located in a heel area 54 and four (4) heel apertures 61. The cavity 59 provides a mounting means thereto a spike retracting mechanism 20 and lid assembly 40. The cavity 59 is formed therewithin said heel portion 54 having particular internal rectangular dimensions providing a snug fit thereto the spike retracting mechanism 20 and lid assembly 40. Said spike retracting mechanism 20 and lid assembly 40 form a rectangular shape sized so as to fit discretely within the heel portion 54. The spike retracting mechanism 20 and lid assembly 40 are held permanently therein said cavity 59 using preferably a durable weather-resistant adhesive 60; however, other fastening means may be used such as screws, rivets, or the like with equal benefit. The insole portion 58 provides a user with a comfortable covering of the spike retracting mechanism 20 and lid assembly 40 using common shoe manufacturing processes and materials.

The spike retracting mechanism 20 further comprises four (4) extendable and retractable cylindrical spikes 22 approximately one-eighth (⅛) inch in diameter which extend outwardly toward a ground or floor surface extending approximately one-quarter (¼) of an inch below a bottom surface of the heel portion 54. Each spike 22 comprises a sharp conical point at a lower end thereof providing an improved traction means thereto a user. Said spikes 22 are slidingly guided therethrough the heel portion 54 via four (4) heel apertures 61 located in a corresponding pattern to that of the spikes 22 providing a guiding inner diameter thereto said spikes 22. Vertical movement of the spikes 22 is provided by a cam plate 31, a lift strap 32, and a manually activated crank shaft 24 (see FIGS. 2 and 3).

Although the apparatus 10 is illustrated here as a common work boot 50, it is understood that various boots and shoes may be configured in like manner comprising the spike retracting mechanism 20, thereby providing an improved traction means thereto a user and as such should not be interpreted as a limiting factor of the invention 10.

Figure 2:
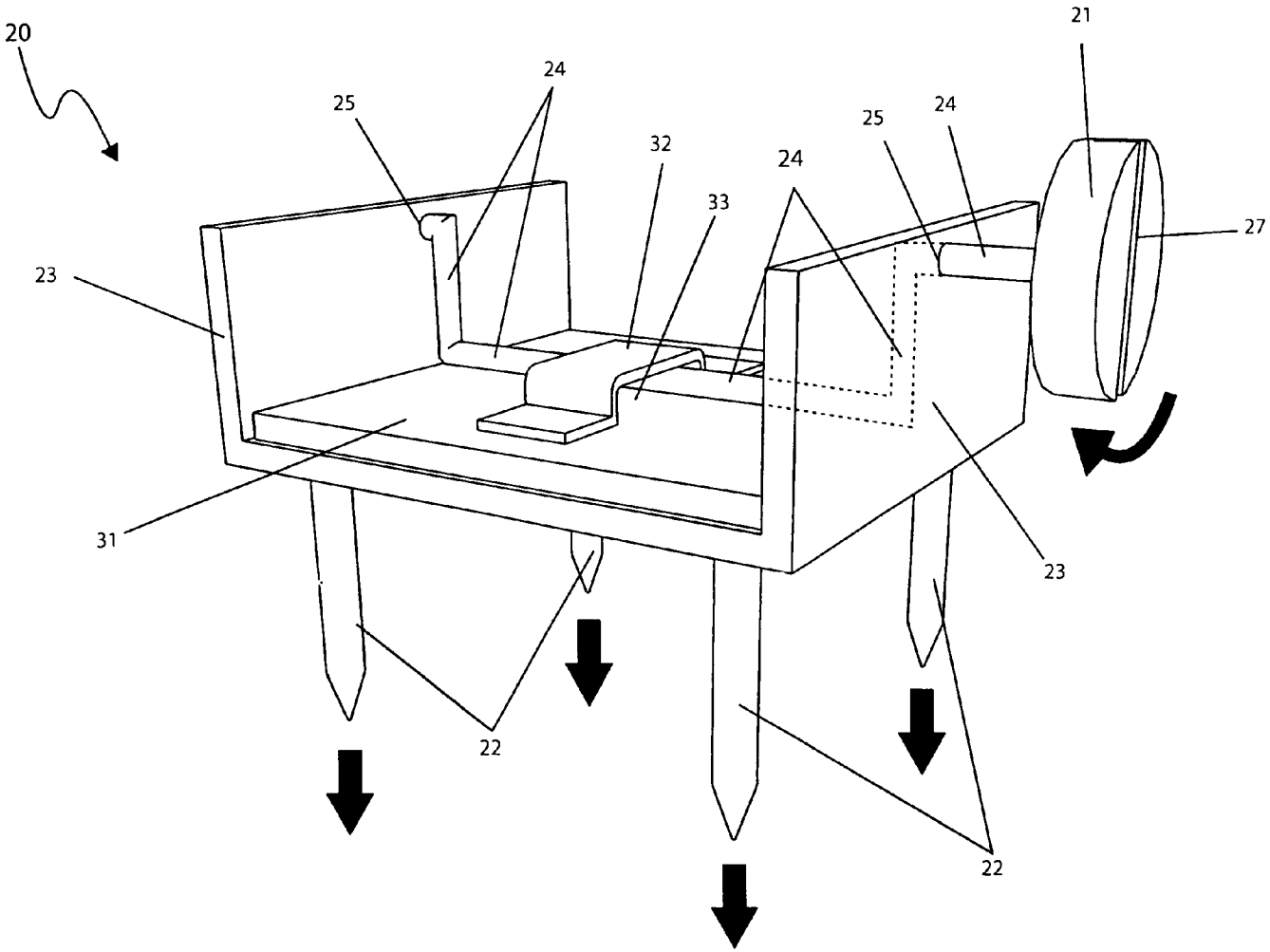
FIG. 2 is a perspective view of a spike retracting mechanism portion 20 depicting an extended state, according to a preferred embodiment of the present invention.

Referring now to FIG. 2, a perspective view of a spike retracting mechanism portion 20 depicting an extended state, according to the preferred embodiment of the present invention, is disclosed. The spike retracting mechanism 20 comprises an activation dial 21, four (4) spikes 22, a base plate 23, a crank shaft 24, a pair of crank shaft apertures 25, four (4) spike apertures 26, an activation dial slot 27, a cam plate 31, a lift strap 32, and a lift strap groove 33. The elements of the spike retracting mechanism 20 are envisioned being made using durable corrosion resistant materials such as plated steel, stainless steel, or the like using stock rolled materials incorporating machining, welding, and common metal forming processes.

The base plate 23 comprises a rugged metal "U"-shaped structure with a horizontal rectangular lower platform approximately two (2) inches long along an edge providing a sturdy mounting platform thereto spike 22 motivating devices therewithin. The base plate 23 provides an attachment means thereto the crank shaft 24 via a pair of opposing crank shaft apertures 25 comprising horizontally aligned drilled holes approximately one-eighth (⅛) inch in diameter located at an intermediate position thereupon the two (2) vertical sides of the base plate 23 along respective upper edges. The crank shaft 24 is rotatably joined thereto the base plate 23 therein the crank shaft apertures 25 extending therebetween said crank shaft apertures 25. The crank shaft 24 further comprises a parallel offset section formed therebetween said apertures 25 being slidingly engaged thereto a cam plate 31. The cam plate 31 comprises a rectangular horizontal metal plate similar in size to the base plate being located above the bottom surface of said base plate 23 and contained therebetween the two vertical sides of said base plate 23. The cam plate 31 provides a means to convert a rotary motion of said crank shaft 24 thereto a vertical motion of said cam plate 31 via insertion therein a lift strap 32 being welded thereto an upper surface of said cam plate 31. The lift strap 32 comprises an inverted "U"-shaped metal strap approximately one-quarter (¼) inch wide comprising an offset section defining an enclosed horizontal lift strap groove 33 therewith the upper surface of the cam plate surface 31. The crank shaft 24 is inserted therein said lift strap groove 33 providing free rotary motion of the crank shaft 24 slidingly inserted therewithin resulting in a vertical displacement of the cam plate 31. The cam plate 31 provides a permanent attachment means thereto four (4) spikes 22 being affixed thereto using welding, press fits, or similar fastening means securing said spikes 22 perpendicularly therein. The spikes 22 are flush with an upper surface of the cam plate 31 and extend perpendicularly downward therefrom said cam plate 31 slidingly protruding therethrough four (4) respective spike apertures 26 located therein the horizontal portion of the base plate 23. The spike retracting mechanism 20 is illustrated here in an extended and locked position with the crank shaft 24. The spikes 22 are held securely in an extended position as the crank shaft 24 is rotated slightly beyond a vertical orientation positioning the aforementioned offset portion of the crank shaft 24 thereagainst an extreme end portion of the lift strap groove 33. While the crank shaft 24 is in this orientation the cam plate 31 and spikes 22 are extended downwardly allowing a user of the apparatus 10 to walk securely upon a snow and/or icy surface. The apparatus 10 is illustrated here depicting four (4) spikes; however, it is understood that any suitable number of spikes 22 and respective features may be utilized based upon particular sizes and styles of shoe assemblies 50 as well as a user's preference.

The crank shaft 24 comprises an end portion which extends therethrough the crank shaft aperture 25 providing an attachment thereto a manually manipulated activation dial 21 being affixed perpendicularly thereto a flat surface of said activation dial 21. The activation dial 21 provides a circular manual grasping means allowing a user to affect a torque thereto the internal crank shaft 24, thereby providing extension and retraction of the spikes 22 as desired. The activation dial 21 comprises a circular knob approximately one (1) inch in diameter comprising parallel vertical flat surfaces providing mechanical engagement of the crank shaft 24 via a centrally located drilled hole therein a rear side thereof being particularly sized so as to engage said crank shaft end 24 using a press fit, welding, or a combination thereof. The actuation dial 21 further comprises an activation dial slot 27 along a front side thereof providing optional manipulation of said activation dial 21 using a coin, tool, or other suitably shaped device. The activation dial slot 27 comprises a large female groove-type feature extending diametrically across a front surface of the activation dial face 21.

Figure 3:
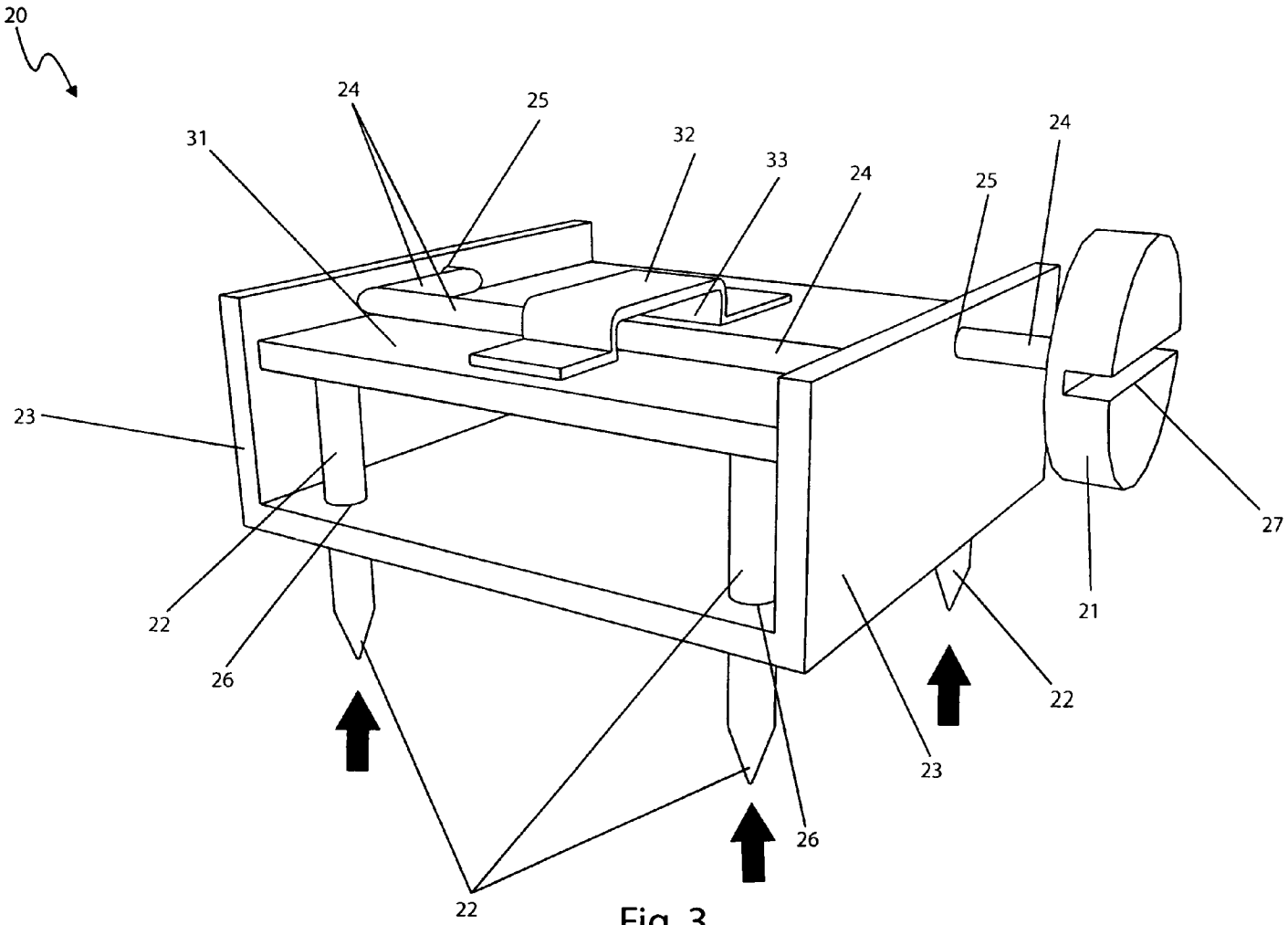
FIG. 3 is a perspective view of a spike retracting mechanism portion 20 depicting a retracted state, according to a preferred embodiment of the present invention.

Referring now to FIG. 3, a perspective view of a spike retracting mechanism portion 20 depicting a retracted state, according to a preferred embodiment of the present invention, is disclosed. The spike retracting mechanism portion 20 is illustrated here showing the crank shaft 24 in the horizontal orientation and the cam plate 31 and attached spikes 22 in a retracted or raised position. The illustrated state of the spike retracting mechanism portion 20 provides a user an option of wearing the apparatus 10 indoors or upon a normal high-friction walking surface.

Figure 4A:
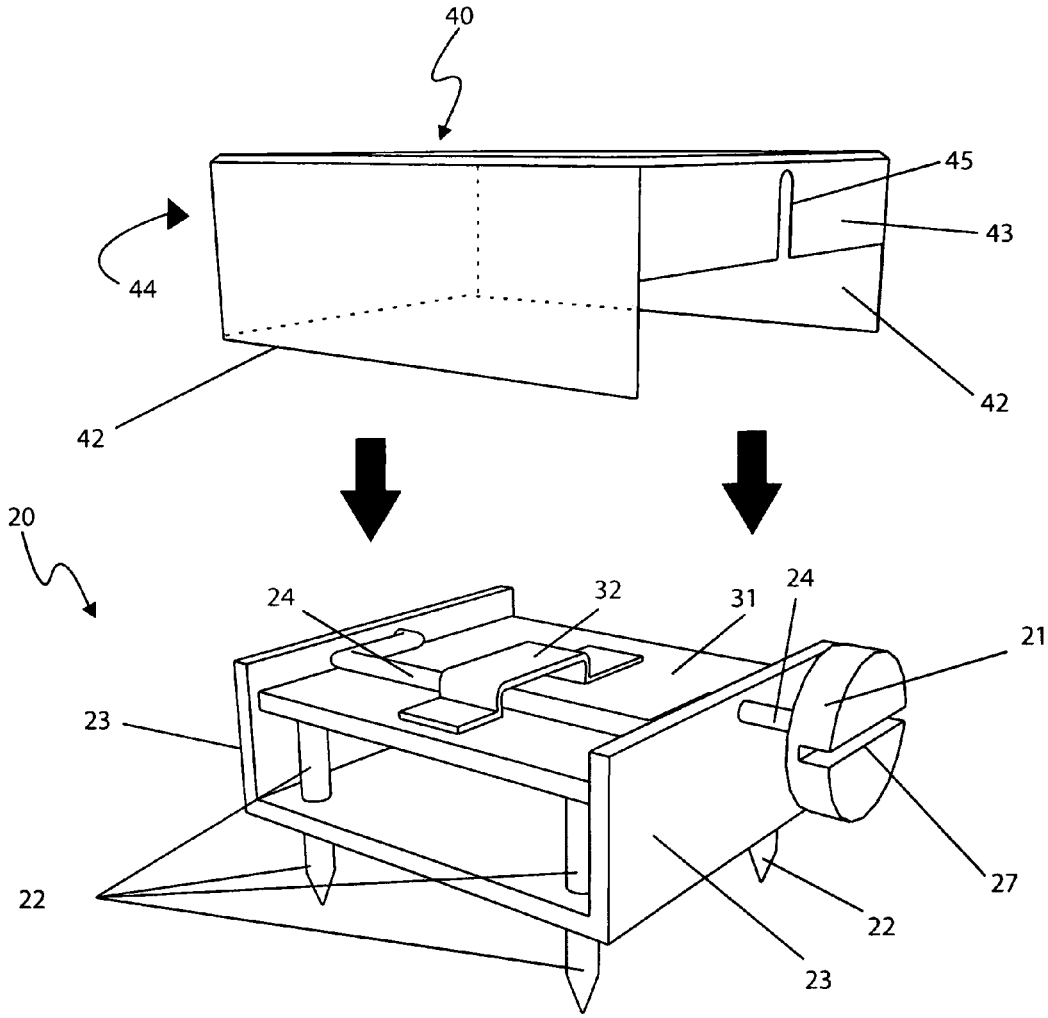
FIG. 4*a* is a perspective of a lid portion 40 depicting application thereto a spike retracting mechanism 20, according to a preferred embodiment of the present invention; and, FIG. 4*b* is a perspective of a spike retracting mechanism 20 depicting a lid portion 40 in an installed state, according to a preferred embodiment of the present invention.
Figure 4B:
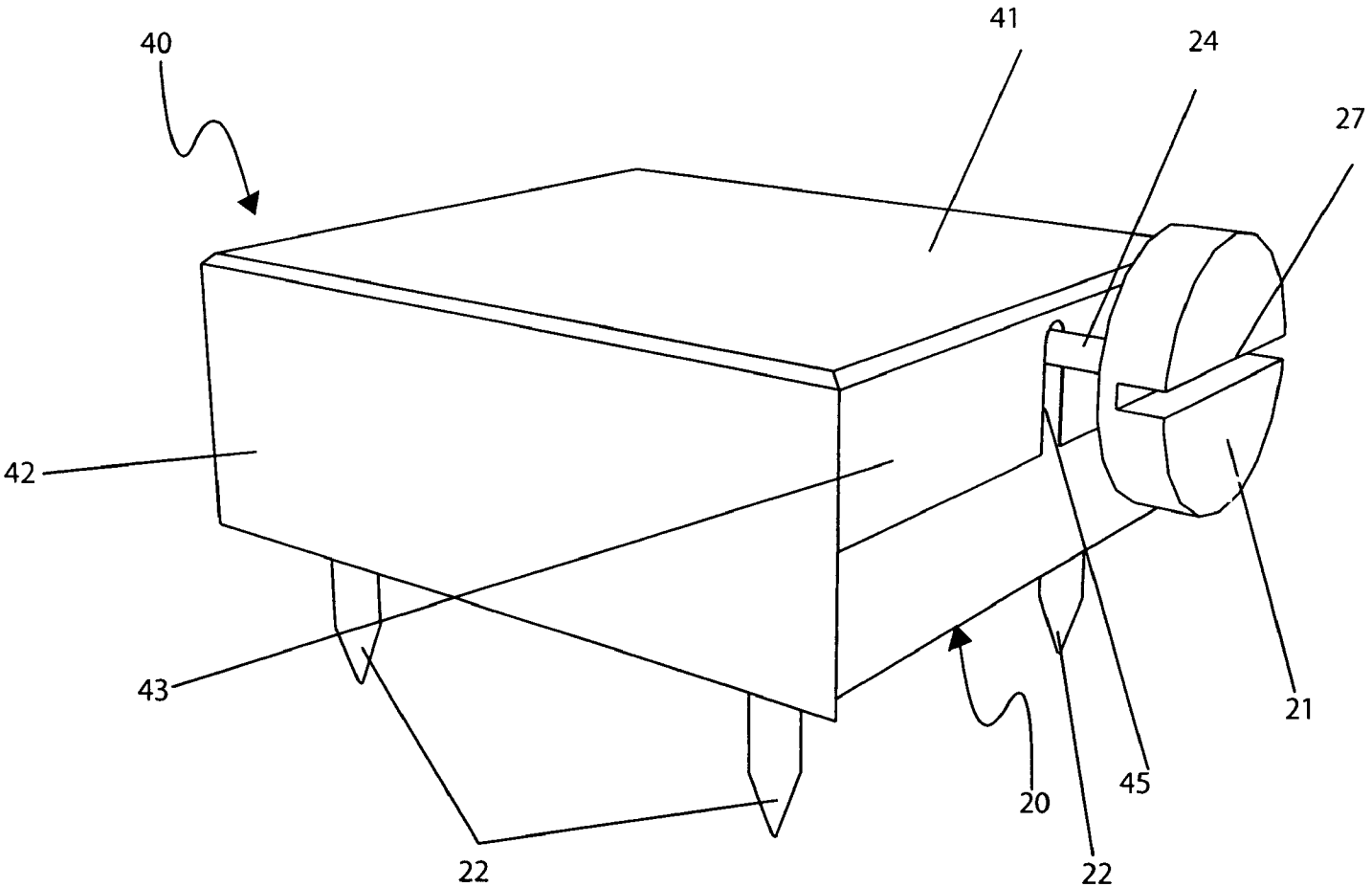

Referring now to FIGS. 4*a* and 4*b*, perspective views of a lid portion 40 application thereto the spike retracting mechanism 20, according to a preferred embodiment of the present invention, are disclosed. The lid 40 comprises a five-sided, open bottomed rectangular box which slidingly engages and covers the spike retracting mechanism 20. The lid 40 works in conjunction therewith the base plate 23 to form a protective housing therearound said spike retracting mechanism 20. The lid 40 comprises a lid top panel 41, a pair of lid side panels 42, a lid front panel 43, a lid rear panel 44, and a lid front panel slot 45. The lid front panel 43 further comprises an integral front lid panel slot 45 at an intermediate location providing clearance thereto the crank shaft 24 which protrudes horizontally therethrough the base plate 23.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIG. 1.

The method of utilizing the apparatus 10 may be achieved by performing the following steps: selecting an appropriate model of the apparatus 10 based upon one's shoe size, occupation, or anticipated surroundings and terrain; applying the apparatus 10 to one's feet in a normal manner; rotating the activation dial 21 using one's hand, a tool, or a coin to retract the spikes 22 below the bottom surface of the heel portion 54; walking in a normal manner over indoor or dry high-friction terrain; rotating the activation dial 21 to extend and lock the spikes 22 in an extended position; walking over snow and/or icy surfaces as desired; retracting and extending the spikes 22 repeatedly using the actuating dial 21 as needed while traveling to/from high-friction surfaces to/from snow and ice covered surfaces; and, utilizing the apparatus 10 to obtain improved traction while walking on snowy/icy surfaces while performing one's occupation, participating in a winter event, or during a normal walking event.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A combined foot wear and heel spike assembly comprising:

a shoe having a heel area provided with a cavity formed therein, a plurality of apertures formed in said heal area and being in communication with said cavity, and an adhesive layer intercalated between a spike activating mechanism and an inner wall of said heel area respectively;

a plurality of spikes disposed at said heel area of said shoe; and, said spike activating mechanism operably being coupled to said spikes and further being seated within said cavity for uniformly adapting said spikes along respective linear paths such that said spikes directly engage a ground surface beneath said shoe, further comprising:

a base having a lower platform and opposed sidewalls extending upwardly therefrom;

a cam plate adjustably interfitted between said sidewalls and remaining parallel to said lower platform during rising and falling motions;

a lift strap attached to a top surface of said cam plate;

a manually activated crank shaft passed through said lift strap and pivotally anchored to said sidewalls respectively; and, an activation dial statically coupled to one end of said crank shaft and being selectively rotatable along clockwise and counter clockwise directions based upon a user input.

2. The combined foot wear and heel spike assembly of claim 1, wherein each of said spikes synchronously rises and falls along corresponding ones said linear travel paths and protrudes outwardly from said apertures in such a manner that respective bottom tips of said spikes directly engage the ground surface.

3. The combined foot wear and heel spike assembly of claim 1, wherein said crank shaft comprises: a central linear section that is axially offset from said opposed ends of said crank shaft, said central linear section maintaining direct contact with said cam plate and biasing said cam plate between lowered and raised positions defined along the vertical travel path.

4. The combined foot wear and heel spike assembly of claim 1, wherein said cam plate is displaced along the vertical travel path when said activation dial is rotatably articulated in a corresponding direction;

wherein each of said spikes is slidably and linearly interposed within said apertures and directly mated to a bottom surface of said cam plate such that said spikes travel in sync with said cam plate.

5. The combined foot wear and heel spike assembly of claim 4, wherein said central linear portion of said crank shaft is coplanar with said opposed ends of said central shaft when said cam plate is biased to a raised position.

6. The combined foot wear and heel spike assembly of claim 1, wherein said spike activating mechanism further comprises:

a lid portion seated over a top portion of said base, said lid portion having a plurality of panels arranged is such a manner to fit around an exterior of said base without interrupting a rotational movement of said activation dial and said crank shaft respectively.

7. A combined foot wear and heel spike assembly comprising:

a shoe having a heel area provided with a cavity formed therein, a plurality of apertures formed in said heal area and being in communication with said cavity, and an adhesive layer intercalated between a spike activating mechanism and an inner wall of said heel area respectively;

a plurality of coextensively shaped spikes disposed at said heel area of said shoe; and, said spike activating mechanism being operably coupled to said spikes and further being seated within said cavity for uniformly adapting said spikes along respective linear paths such that said spikes directly engage a ground surface beneath said shoe, further comprising:

a base having a lower platform and opposed sidewalls extending upwardly therefrom;

a cam plate adjustably interfitted between said sidewalls and remaining parallel to said lower platform during rising and falling motions;

a lift strap attached to a top surface of said cam plate;

a manually activated crank shaft passed through said lift strap and pivotally anchored to said sidewalls respectively; and, an activation dial statically coupled to one end of said crank shaft and being selectively rotatable along clockwise and counter clockwise directions based upon a user input.

8. The combined foot wear and heel spike assembly of claim 7, wherein each of said spikes synchronously rises and falls along corresponding ones said linear travel paths and protrudes outwardly from said apertures in such a manner that respective bottom tips of said spikes directly engage the ground surface.

9. The combined foot wear and heel spike assembly of claim 7, wherein said crank shaft comprises: a central linear section that is axially offset from said opposed ends of said crank shaft, said central linear section maintaining direct contact with said cam plate and biasing said cam plate between lowered and raised positions defined along the vertical travel path.

10. The combined foot wear and heel spike assembly of claim 7, wherein said cam plate is displaced along the vertical travel path when said activation dial is rotatably articulated in a corresponding direction;

wherein each of said spikes is slidably and linearly interposed within said apertures and directly mated to a bottom surface of said cam plate such that said spikes travel in sync with said cam plate.

11. The combined foot wear and heel spike assembly of claim 10, wherein said central linear portion of said crank shaft is coplanar with said opposed ends of said central shaft when said cam plate is biased to a raised position.

12. The combined foot wear and heel spike assembly of claim 7, wherein said spike activating mechanism further comprises:

a lid portion seated over a top portion of said base, said lid portion having a plurality of panels arranged is such a manner to fit around an exterior of said base without interrupting a rotational movement of said activation dial and said crank shaft respectively.

* * * * *